US011882951B2

(12) United States Patent
Caldwell

(10) Patent No.: US 11,882,951 B2
(45) Date of Patent: Jan. 30, 2024

(54) BASEBALL CAP STORAGE DEVICE

(71) Applicant: Andy Caldwell, Little Rock, AR (US)

(72) Inventor: Andy Caldwell, Little Rock, AR (US)

( * ) Notice: Subject to any disclaimer, the term of this patent is extended or adjusted under 35 U.S.C. 154(b) by 98 days.

(21) Appl. No.: 17/720,902

(22) Filed: Apr. 14, 2022

(65) Prior Publication Data

US 2023/0329467 A1 Oct. 19, 2023

(51) Int. Cl.

| | |
|---|---|
| ***A45C 11/02*** | (2006.01) |
| ***A47G 25/10*** | (2006.01) |
| ***B65D 85/18*** | (2006.01) |
| ***A47F 7/06*** | (2006.01) |

(52) U.S. Cl.

CPC ..... *A47G 25/10* (2013.01); *A45C 11/02* (2013.01); *A47F 7/06* (2013.01); *B65D 85/18* (2013.01)

(58) Field of Classification Search

CPC ..... A45C 11/02; B65D 85/18; A47G 25/10; A47F 1/126; A47F 7/06; A47F 3/08

USPC ..... 206/208; 211/30

See application file for complete search history.

(56) References Cited

U.S. PATENT DOCUMENTS

| | | | | |
|---|---|---|---|---|
| 2,559,699 | A | 7/1951 | Bard | |
| 2,693,275 | A * | 11/1954 | Smith | A45C 11/02 206/8 |
| 5,480,023 | A * | 1/1996 | Puller | A45C 7/0063 206/8 |
| 7,147,112 | B2 | 12/2006 | Penson | |
| 9,706,824 | B2 | 7/2017 | Tuning | |
| 9,901,188 | B2 * | 2/2018 | Murphy | A47F 1/126 |
| 10,206,521 | B2 * | 2/2019 | Murphy | A47F 3/002 |
| 10,273,075 | B2 * | 4/2019 | Brantley | B65D 43/166 |
| 10,376,083 | B1 * | 8/2019 | Lee | A47F 7/06 |
| 10,433,625 | B1 * | 10/2019 | Belizaire | A45C 11/02 |
| D919,967 | S | 5/2021 | Hamilton | |
| 11,213,153 | B1 * | 1/2022 | Gooden | A47G 25/10 |
| 2011/0253559 | A1 | 10/2011 | McDonald | |
| 2017/0224131 | A1 * | 8/2017 | Murphy | A47F 3/002 |
| 2017/0231346 | A1 | 8/2017 | Todmann | |
| 2018/0132630 | A1 * | 5/2018 | Murphy | A47F 3/002 |
| 2019/0031428 | A1 * | 1/2019 | Brantley | B65D 43/24 |
| 2020/0359726 | A1 | 11/2020 | Hamilton | |

FOREIGN PATENT DOCUMENTS

| | | |
|---|---|---|
| WO | WO2019030720 | 2/2019 |

* cited by examiner

*Primary Examiner* — Kimberley S Wright

(57) ABSTRACT

A baseball cap storage device for storing and displaying baseball caps includes a base and a shell. A first mold and an end plate are engaged to and extend from an upper face of the base proximate to a first and second ends of the base, respectively. A second mold is slidably attached to the base and is selectively positionable between the first mold and the end plate. A biaser is attached to the end plate and biases the second mold toward the first mold. The first mold abuts a concave face of a plurality of baseball caps, which are folded and nested. The second mold abuts a convex face of the plurality of baseball caps to fixedly position the plurality of baseball caps between the first and second molds. A shell, which has an open bottom, is selectively positionable upon the base to cover the plurality of baseball caps.

12 Claims, 3 Drawing Sheets

BASEBALL CAP STORAGE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to hat storage devices and more particularly pertains to a new hat storage device for storing and displaying baseball caps. The present invention discloses a hat storage device for baseball caps that allows a plurality of baseball caps to be stored and displayed in a horizontal, nested configuration that is maintained by sandwiching the baseballs caps between a pair of molds.

(2) Description of Related Art Including Information Disclosed Under 37 CFR 1.97 and 1.98

The prior art relates to hat storage devices. Prior art hat storage devices may comprise single and multicompartment boxes, open front, hangable boxes within strings to support partially nested baseball caps, baseball cap shaped containers, and containers with hingable doors. What is lacking in the prior art is a hat storage device comprising a fixed mold and a slidable mold between which a plurality of baseball caps is positionable for storage and display.

BRIEF SUMMARY OF THE INVENTION

An embodiment of the disclosure meets the needs presented above by generally comprising a base and a shell. A first mold is engaged to and extends from an upper face of the base, proximate to a first end of the base. An end plate is engaged to and extends substantially perpendicularly from the upper face proximate to a second end of the base. A second mold is slidably attached to the base so that the second mold is selectively positionable between the first mold and the end plate. A biaser is attached to the end plate and is operationally engaged to the second mold to bias the second mold toward the first mold. The first mold is configured to abut a concave face of a plurality of baseball caps, which are folded and nested. The second mold is configured to abut a convex face of the plurality of baseball caps to fixedly position the plurality of baseball caps between the first mold and the second mold. A shell, which has an open bottom, is selectively positionable upon the base to cover the plurality of baseball caps.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
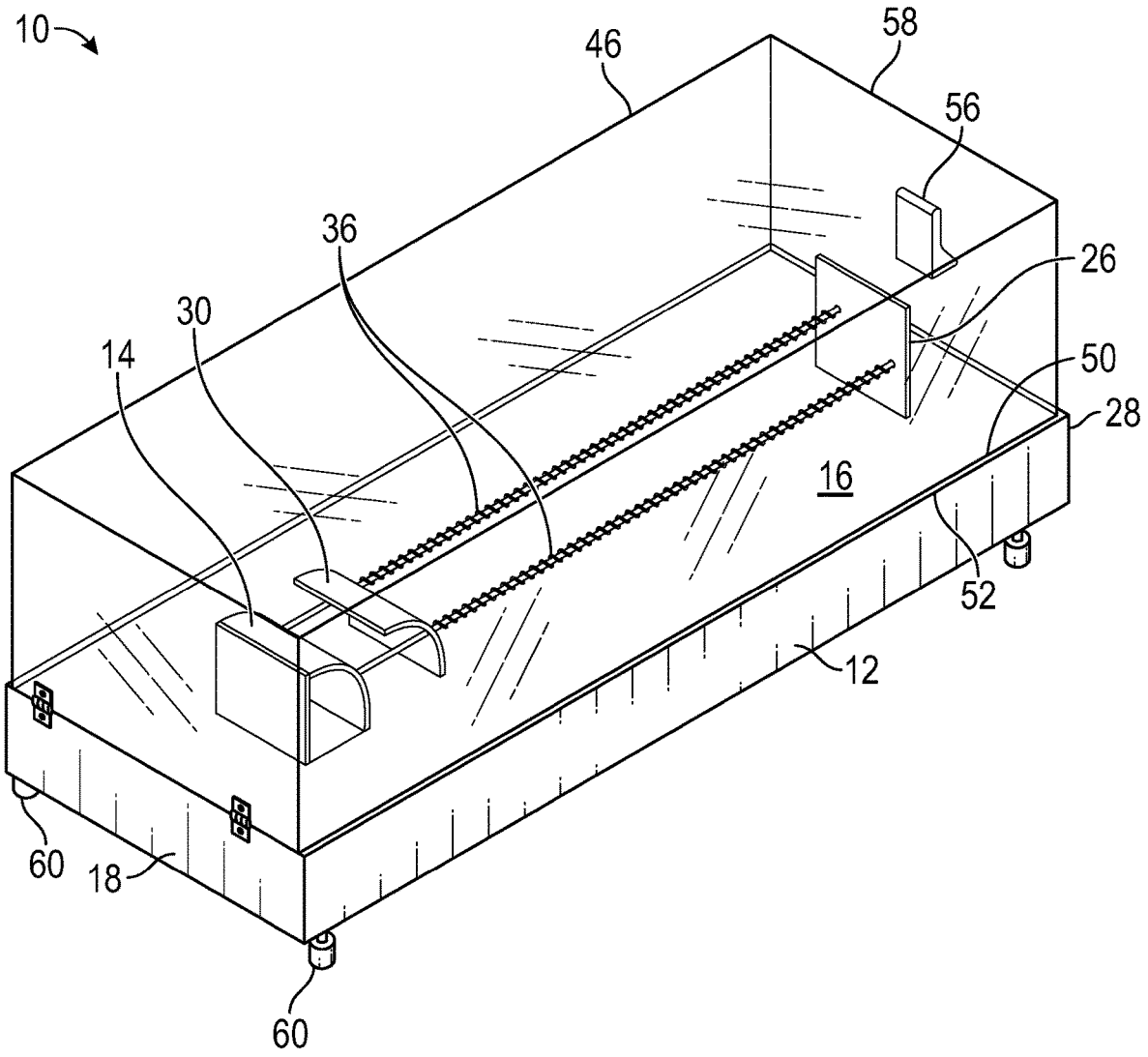
FIG. 1 is an isometric perspective view of a baseball cap storage device according to an embodiment of the disclosure.

With reference now to the drawings, and in particular to FIGS. 1 through 4 thereof, a new hat storage device embodying the principles and concepts of an embodiment of the disclosure and generally designated by the reference numeral 10 will be described.

As best illustrated in FIGS. 1 through 4, the baseball cap storage device 10 generally comprises a base 12, which may be elongated cuboid shaped, as shown in FIG. 1, or alternatively shaped, such as, but not limited to, square, elongated oval, and the like.

A first mold 14 is engaged to and extends from an upper face 16 of the base 12, proximate to a first end 18 of the base 12. The first mold 14 comprises a first panel 20 and a fixed plate 22. The first panel 20, which is substantially rigid, is engaged to and extends arcuately from the upper face 16 toward the first end 18 of the base 12. The fixed plate 22 is engaged to and extends from a terminus 24 of the first panel 20 distal from upper face 16 of the base 12. The fixed plate 22 also is engaged the upper face 16 and extends substantially perpendicularly from the upper face 16.

An end plate 26 is engaged to and extends substantially perpendicularly from the upper face 16 proximate to a second end 28 of the base 12. A second mold 30 is slidably attached to the base 12 so that the second mold 30 is selectively positionable between the first mold 14 and the end plate 26. The second mold 30 comprises a second panel 32, which is shaped substantially complementarily to the first panel 20. The present invention also anticipates the second panel 32 and the first panel 20 being radiused to substantially match a curvature of a baseball cap 34 that is folded.

A biaser 36 is attached to the end plate 26 and is operationally engaged to the second mold 30 to bias the second mold 30 toward the first mold 14. The first mold 14 is configured to abut a concave face 38 of a plurality of baseball caps 34, which are folded and nested. "Baseball cap" in the context of the present invention should be interpreted to mean a baseball cap 34 or a baseball like cap. More specifically, "baseball cap" should be interpreted to mean any hat having a rigid or semirigid bill piece extending from a flexible head covering piece. The second mold 30 is configured to abut a convex face 40 of the plurality of baseball caps 34 to fixedly position the plurality of baseball caps 34 between the first mold 14 and the second mold 30.

The biaser 36 may comprise a pair of rods 42 and a pair of springs 44, other biasing means, such as, but not limited to, extensible nested cylinders, and the like. The rods 42 are engaged to and extends between the first mold 14 and the end plate 26. The rods 42 of the pair of rods 42 are spaced such that the plurality of baseball caps 34 is insertable between the rods 42 to rest upon the base 12. The second mold 30 is slidably attached to the pair of rods 42. Each spring 44 is positioned around a respective rod 42, between the end plate 26 and the second mold 30, so that the spring 44 is tensioned as the second mold 30 is motivated toward the end plate 26. The springs 44 also could be engaged to and extend between the first mold 14 the second mold 30.

As shown in FIG. 1, the rods 42 are parallel to each other and to the base 12, but the rods 42 are not positioned equally distant from the base 12. This configuration facilitates insertion of the plurality of baseball caps 34 between the rod 42. The present invention also anticipates the rods 42 being positioned substantially equally distant from the base 12.

Figure 2:
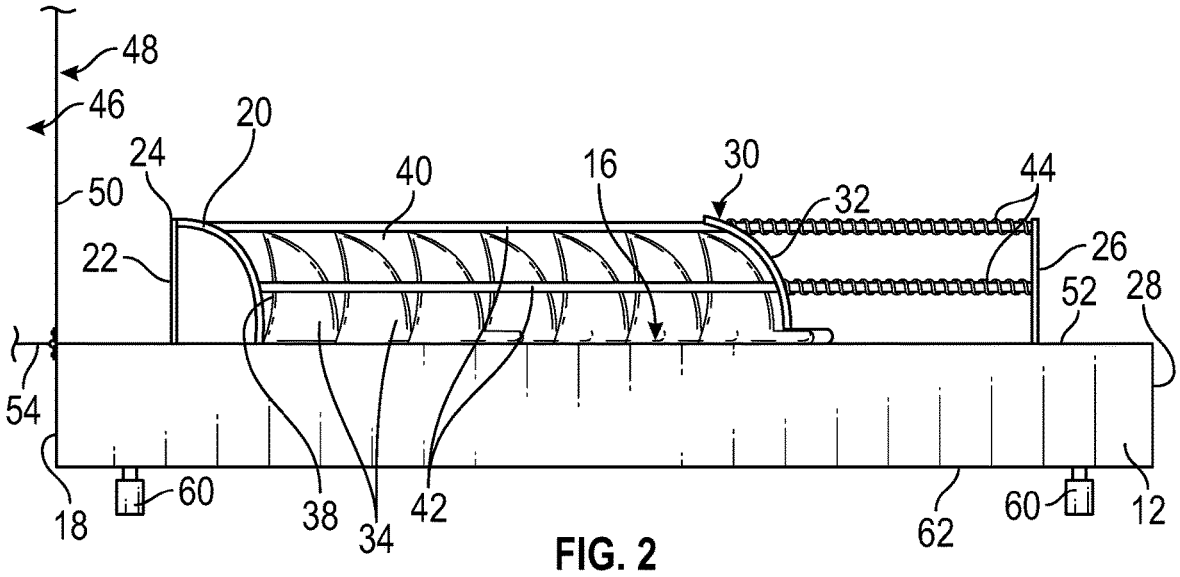
FIG. 2 is an in-use view of an embodiment of the disclosure.
Figure 3:
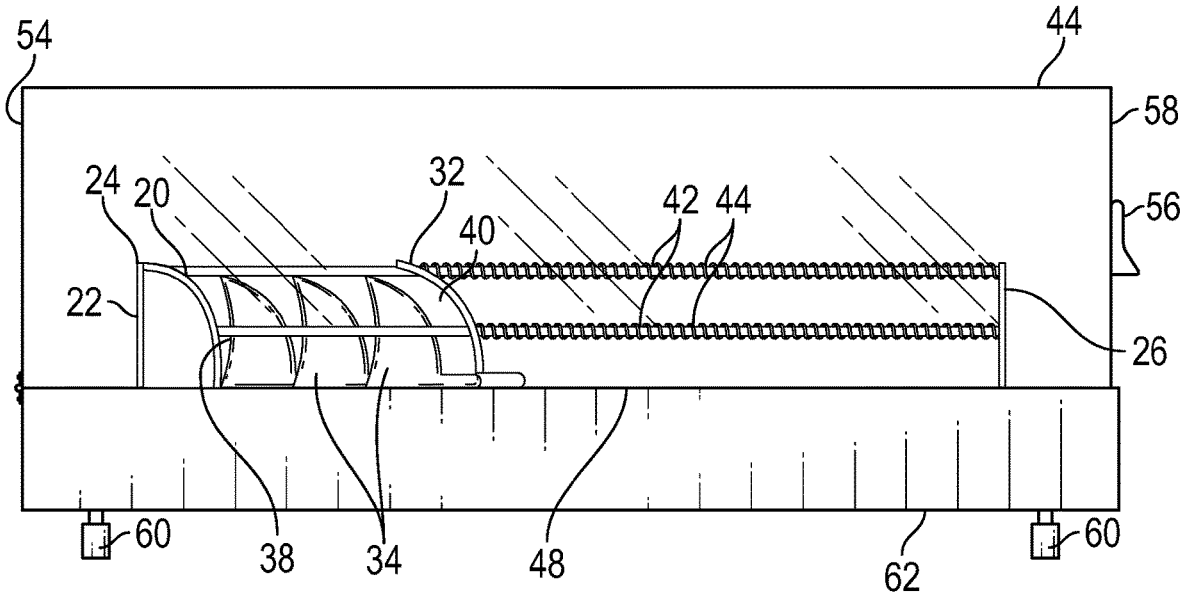
FIG. 3 is an in-use view of an embodiment of the disclosure.
Figure 4:
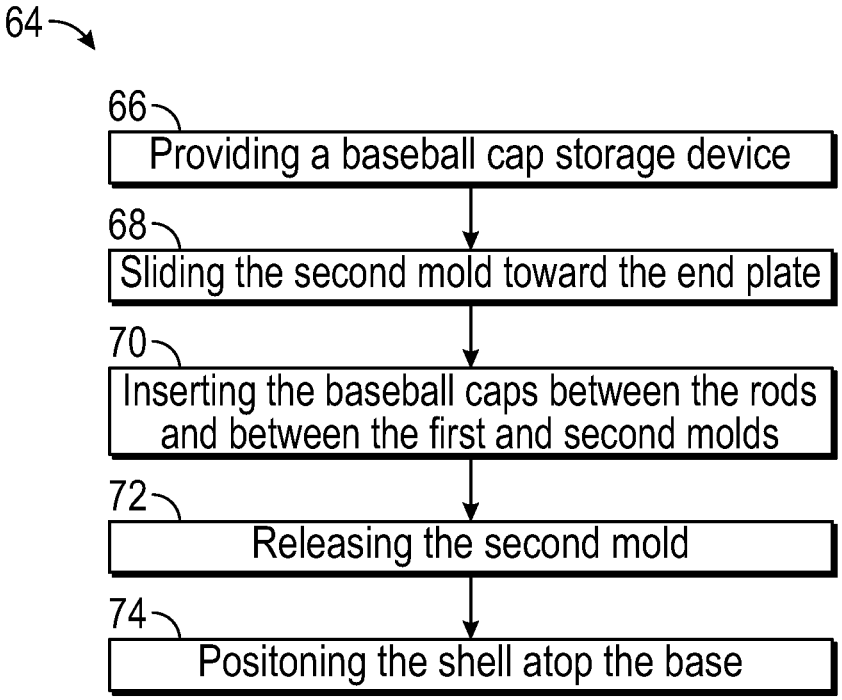
FIG. 4 is a flow diagram for a method utilizing an embodiment of the disclosure.

A shell 46, which has an open bottom 48, is selectively positionable upon the base 12 to cover the plurality of baseball caps 34. The open bottom 48 has a perimeter 50 that is shaped and sized substantially complementarily to a circumference 52 of the upper face 16 of the base 12. The shell 46 is substantially transparent and may comprises plastic, glass, or the like, thus allowing the baseball caps 34 to be viewed while stored. The shell 46 protects the baseball caps 34 for dust, water, splashes, and the like. While the shell 46 depicted in FIGS. 1-3 is cuboid, the present invention also anticipates the shell 46 being domed. The present invention is anticipated to be useful in storing and displaying a plurality of baseball caps 34 while maintaining their shape.

A first endpoint 54 of the shell 46 may be hingedly engaged to the first end 18 of the base 12. A handle 56 is engaged to a second endpoint 58 of the shell 46 and is configured to be grasped in a hand of a user. The user can hinge the shell 46 relative to the base 12, using the handle 56, to add and remove baseball caps 34.

A plurality of feet 60 is engaged to a lower face 62 of said base 12. The feet 60 comprise rubber, silicone, or elastomer and thus are resiliently compressible and configured to frictionally engage a surface upon which the base 12 is positioned.

The baseball cap storage device 10 enables a method 64 of storing and displaying a plurality of baseball caps. The method 64 comprises a first step 66 of providing a baseball cap storage device 10 according to the specification above. A second step 68 of the method 64 is sliding the second mold 30 toward the end plate 26. A third step 70 of the method 64 is inserting a plurality of baseball caps 34, which are folded and nested, between the rods 42 and between the first mold 14 and the second mold 30 so that the concave face 38 of the plurality of baseball caps 34 abuts the first mold 14. A fourth step 72 of the method 64 is releasing the second mold 30 so that the second mold 30 abuts the convex face 40 of the plurality of baseball caps 34. A fifth step 74 of the method 64 is positioning the shell 46 atop the base 12. The baseball caps 34 of the plurality of baseball caps 34 can be positioned between the first mold 14 and the second mold 30 as a group, as groups, or individually, and can be selectively removed individually or in groups.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A baseball cap storage device comprising:

a base;

a first mold engaged to and extending from an upper face of the base proximate to a first end of the base;

an end plate engaged to and extending substantially perpendicularly from the upper face proximate to a second end of the base;

a second mold slidably attached to the base, such that the second mold is selectively positionable between the first mold and the end plate;

a biaser attached to the end plate and operationally engaged to the second mold, such that the second mold is biased toward the first mold, wherein the first mold is configured for abutting a concave face of a plurality of baseball caps, which are folded and nested, and the second mold is configured for abutting a convex face of the plurality of baseball caps, such that the plurality of baseball caps is fixedly positioned between the first mold and the second mold; and a shell having an open bottom, such that the shell is selectively positionable upon the base for covering the plurality of baseball caps.

2. The baseball cap storage device of claim 1, wherein the base is elongated cuboid shaped.

3. The baseball cap storage device of claim 1, wherein:

the first mold comprises:

a first panel, the first panel being engaged to and extending arcuately from the upper face toward the first end of the base, the first panel being substantially rigid, and a fixed plate engaged to and extending from a terminus of the first panel distal from upper face of the base, the fixed plate being engaged the upper face such that the fixed plated extends substantially perpendicularly from the upper face; and the second mold comprises a second panel shaped substantially complementarily to the first panel.

4. The baseball cap storage device of claim 1, wherein the biaser comprises:

a pair of rods engaged to and extending between the first mold and the end plate, the rods of the pair of rods being spaced such that the plurality of baseball caps is insertable between the rods to rest upon the base, the second mold being slidably attached to the pair of rods; and a pair of springs, each spring being positioned around a respective rod between the end plate and the second mold, such that the spring is tensioned as the second mold is motivated toward the end plate.

5. The baseball cap storage device of claim 1, wherein the open bottom has a perimeter shaped and sized substantially complementarily to a circumference of the upper face of the base.

6. The baseball cap storage device of claim 1, wherein the shell is substantially transparent.

7. The baseball cap storage device of claim 1, wherein the shell comprises plastic.

8. The baseball cap storage device of claim 1, wherein a first endpoint of the shell is hingedly engaged to the first end of the base.

9. The baseball cap storage device of claim 8, further including a handle engaged to a second endpoint of the shell, wherein the handle is configured for grasping in a hand of a user, positioning the user for hinging the shell relative to the base for accessing the plurality of baseball caps.

10. The baseball cap storage device of claim 1, further including a plurality of feet engaged to a lower face of the base, the feet comprising rubber, silicone, or elastomer, such that the feet are resiliently compressible, wherein the feet are configured for frictionally engaging a surface upon which the base is positioned.

11. A method of storing and displaying a plurality of baseball caps, the method comprising the steps of:

providing a baseball cap storage device comprising:

a base, a first mold engaged to and extending from an upper face of the base proximate to a first end of the base, an end plate engaged to and extending substantially perpendicularly from the upper face proximate to a second end of the base, a second mold slidably attached to the base, such that the second mold is selectively positionable between the first mold and the end plate, a biaser attached to the end plate and operationally engaged to the second mold, the biaser comprising:

a pair of rods engaged to and extending between the first mold and the end plate, the rods of the pair of rods being spaced such that a plurality of baseball caps, which are folded and nested, is insertable between the rods to rest upon the base, the second mold being slidably attached to the pair of rods, and a pair of springs, each spring being positioned around a respective rod between the end plate and the second mold, such that the spring is tensioned as the second mold is motivated toward the end plate, wherein the first mold is configured for abutting a concave face of the plurality of baseball caps and the second mold is configured for abutting a convex face of the plurality of baseball caps, such that the plurality of baseball caps is fixedly positioned between the first mold and the second mold, and a shell having an open bottom, such that the shell is selectively positionable upon the base for covering the plurality of baseball caps, the shell being substantially transparent;

sliding the second mold toward the end plate;

inserting a plurality of baseball caps, which are folded and nested, between the rods and between the first mold and the second mold, such that the concave face of the plurality of baseball caps abuts the first mold;

releasing the second mold, such that the second mold abuts the convex face of the plurality of baseball caps; and positioning the shell atop the base.

12. A baseball cap storage device comprising:

a base, the base being elongated cuboid shaped;

a first mold engaged to and extending from an upper face of the base proximate to a first end of the base, the first mold comprising:

a first panel, the first panel being engaged to and extending arcuately from the upper face toward the first end of the base, the first panel being substantially rigid, and a fixed plate engaged to and extending from a terminus of the first panel distal from upper face of the base, the fixed plate being engaged the upper face such that the fixed plated extends substantially perpendicularly from the upper face;

an end plate engaged to and extending substantially perpendicularly from the upper face proximate to a second end of the base;

a second mold slidably attached to the base, such that the second mold is selectively positionable between the first mold and the end plate, the second mold comprising a second panel shaped substantially complementarily to the first panel;

a biaser attached to the end plate and operationally engaged to the second mold, such that the second mold is biased toward the first mold, wherein the first mold is configured for abutting a concave face of a plurality of baseball caps, which are folded and nested, and the second mold is configured for abutting a convex face of the plurality of baseball caps, such that the plurality of baseball caps is fixedly positioned between the first mold and the second mold, the biaser comprising:

a pair of rods engaged to and extending between the first mold and the end plate, the rods of the pair of rods being spaced such that the plurality of baseball caps is insertable between the rods to rest upon the base, the second mold being slidably attached to the pair of rods, and a pair of springs, each spring being positioned around a respective rod between the end plate and the second mold, such that the spring is tensioned as the second mold is motivated toward the end plate;

a shell having an open bottom, such that the shell is selectively positionable upon the base for covering the plurality of baseball caps, the open bottom having a perimeter shaped and sized substantially complementarily to a circumference of the upper face of the base, the shell being substantially transparent, the shell comprising plastic, a first endpoint of the shell being hingedly engaged to the first end of the base;

a handle engaged to a second endpoint of the shell, wherein the handle is configured for grasping in a hand of a user, positioning the user for hinging the shell relative to the base for accessing the plurality of baseball caps; and a plurality of feet engaged to a lower face of the base, the feet comprising rubber, silicone, or elastomer, such that the feet are resiliently compressible, wherein the feet are configured for frictionally engaging a surface upon which the base is positioned.

* * * * *